US005406886A

United States Patent [19]

Schneider et al.

[11] Patent Number: 5,406,886

[45] Date of Patent: Apr. 18, 1995

[54] INKING SYSTEM FOR A ROTARY PRESS

[75] Inventors: Georg Schneider, Würzburg; Wolfgang O. Reder, Veitshöchheim, both of Germany

[73] Assignee: Koenig & Bauer Aktiengesellschaft, Wurzburg, Germany

[21] Appl. No.: 181,113

[22] Filed: Jan. 13, 1994

[30] Foreign Application Priority Data

Jan. 13, 1993 [DE] Germany ..... 43 00 683.3

[51] Int. Cl.[6] ..... B41F 31/14

[52] U.S. Cl. ..... 101/349; 101/DIG. 38

[58] Field of Search ..... 101/349, 350, 148, 207–210, 101/DIG. 38, 348, 351, 352

[56] References Cited

U.S. PATENT DOCUMENTS 516,620 3/1894 Waterston .
1,675,448 7/1928 Carson .
1,915,837 6/1933 Porter .

FOREIGN PATENT DOCUMENTS 0141058 5/1985 European Pat. Off. .
0236105 9/1987 European Pat. Off. .
2524793 1/1976 Germany .
3143909 5/1983 Germany .
4007775 9/1991 Germany .
656076 8/1951 United Kingdom .

OTHER PUBLICATIONS

Patent Abstracts of Japan Pub. #JP62035845; App.#JP850176001.

*Primary Examiner*—J. Reed Fisher
*Attorney, Agent, or Firm*—Jones, Tullar & Cooper

[57] ABSTRACT

An inking system for a rotary printing press is provided in which an ink application roller moves along in a frictionally engaged manner between an ink friction cylinder, which moves back and forth in the axial direction, and a plate cylinder to transfer ink to the plate cylinder for producing two quarter-cylinder-wide prints of maximum width and one half-cylinder-wide panoramic print of maximum width. Ink-free zones between the type matter on the plate cylinder are spaced from each other by less than distances between ink-free zones on an ink ductor. The ink application roller has annular grooves in its jacket surface and is disposed so that it moves back and forth at the same axial traversing frequency as the ink friction cylinder, but with a lesser traversing length.

6 Claims, 5 Drawing Sheets

INKING SYSTEM FOR A ROTARY PRESS

FIELD OF THE INVENTION

The present invention is directed generally to an inking system for a rotary press. More particularly, the present invention is directed to an inking system for a web-fed rotary printing press. Most specifically, the present invention is directed to a multiple color inking system for a web-fed rotary printing press. An ink ductor roller is provided with several axially spaced annular jacket faces. Each of these faces receives ink from a separate ink reservoir. Several ink friction rollers and ink application rollers are used, in conjunction with an ink film roller and ink transfer rollers, to supply the various inks to printing plates on a plate cylinder. The various colors of inks are supplied to the printing plates on the plate cylinder in a manner which provides uniform, complete ink coverage of the plates while avoiding ink overlap or mixing.

BACKGROUND OF THE INVENTION

It is generally known to position ink application rollers in contact with a plate cylinder. These ink application rollers transfer ink to plates on the plate cylinder from ink friction cylinders which are supported for rotational movement, and which also simultaneously move back and forth in an axial direction. Because of the back-and-forth movement of these ink friction cylinders, an even ink distribution over half the width of the plate cylinder becomes possible, for example with so-called panoramic printing, even though the ink ductor roller has over its length a plurality, for example three, grooves located on its circumference with these grooves receiving separating shield portions of ink boxes or reservoirs which are disposed in the axial direction of the ink ductor roller.

A disadvantage with this type of inking system is that in those cases where a half-cylinder-wide panoramic print of maximum width and two quarter-cylinder-wide prints of maximum width are being printed, the inks are apt to run together when being transferred. This is because the length of the axial stroke of the ink friction cylinder must at least correspond to the width of an ink-free zone which results from a separating wall between two ink boxes or reservoirs and which must be compensated by the ink friction cylinder in case of panoramic printing. In this case, the distances of the ink-free zones between the type matter of maximum width on the plates of the plate cylinder are less than the distances between the ink-free zones on the ink ductor, so that the individual inks are apt to run together on the type matter.

SUMMARY OF THE INVENTION

It is an object of the present invention to provide an inking system for a rotary printing press.

Another object of the present invention is to provide an inking system for a web-fed rotary printing press.

A further object of the present invention is to provide a multiple color inking system for a web-fed rotary printing press.

Still another object of the present invention is to provide an inking system which uses an ink ductor roller having annular recesses.

Yet a further object of the present invention is to provide an inking system having axially shiftable ink friction rollers and ink application rollers.

Even still another object of the present invention is to provide an inking system for a printing press having a plate cylinder with a plurality of axially separated printing plates.

As will be set forth in detail in the description of the preferred embodiment which is presented subsequently, the inking system for a web-fed rotary printing press in accordance with the present invention utilizes an ink ductor roller that has several annular jacket faces which are separated by annular grooves have first widths. Each jacket face is supplied with a particular color of ink from an ink box or reservoir. The individual inks are transferred from the ink ductor to an ink film roller and thence to first and second sets of ink transfer rollers and ink friction cylinders. The ink friction cylinder in each of these sets is supported for axial movement as well as for rotation. The ink transfer roller in each set has spaced jacket faces that are separated by annular grooves whose widths are the same as the widths of the annular grooves on the ink ductor roller.

Inks are transferred from the second ink cylinder or friction roller to first and second ink application rollers. These ink application rollers have annular jackets which are separated by annular grooves whose widths are less than the widths of the annular grooves in the ink transfer rollers and the ink ductor roller. Both of the ink application rollers are in contact with the plate cylinder and both rotate and also move axially in a back and forth manner because of their frictional contact with the second ink friction roller. A plurality of printing plates are secured to the plate cylinder and are separated axially by annular grooves. These annular grooves have a third width which is less than the ink ductor groove widths but greater than the ink application roller annular groove widths.

The difference in groove widths, together with the axial movement of the ink friction cylinders and the ink application rollers facilitates the even, thorough, uniform dispersal of the several various ink colors from the ink boxes or reservoirs to the several printing plates on the plate cylinder in a manner which does not allow the inks to intermingle. One half cylinder wide panoramic plate and two quarters cylinder wide printing plates of maximum width can be secured to the surface of the plate cylinder and can be completely inked in the desired color supplied by the appropriate ink box or reservoir. Since the axial spacings of the plates on the plate cylinders are greater than the widths of the annular grooves on the ink applicator rollers but less than the widths of the annular grooves on the ink ductor roller, each plate on the plate cylinder is completely covered with printing ink without any intermixing of the inks in the edge areas of the printing plates.

The inking system for a web-fed rotary printing press in accordance with the present invention overcomes the limitations of the prior art devices. It is a substantial advance in the art.

BRIEF DESCRIPTION OF THE DRAWINGS

While the novel features of the inking system for a rotary printing press in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
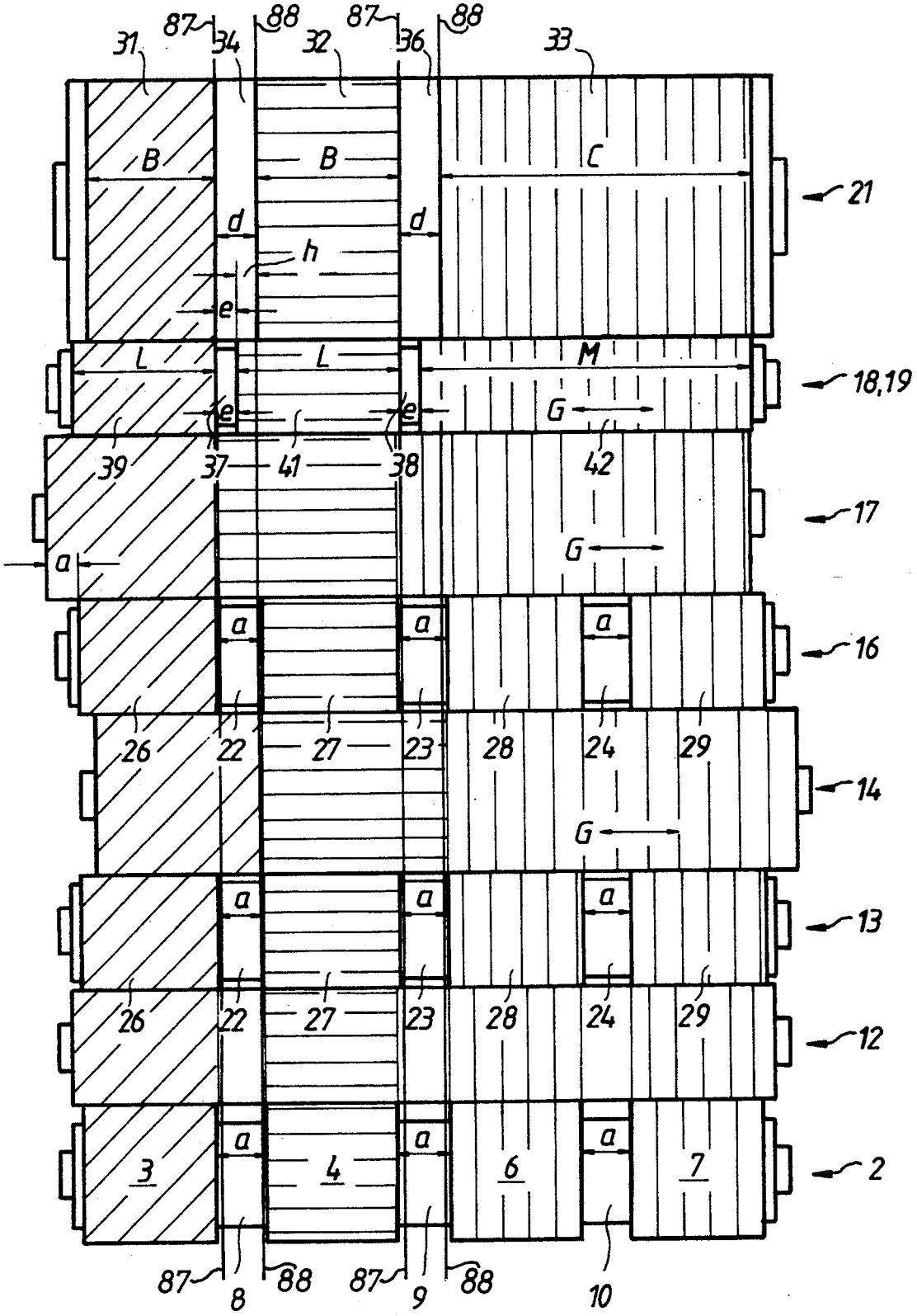
FIG. 1 is a schematic front elevational view of the inking system in accordance with the present invention with the ink application rollers and the ink friction rollers in first axial end positions.
Figure 2:
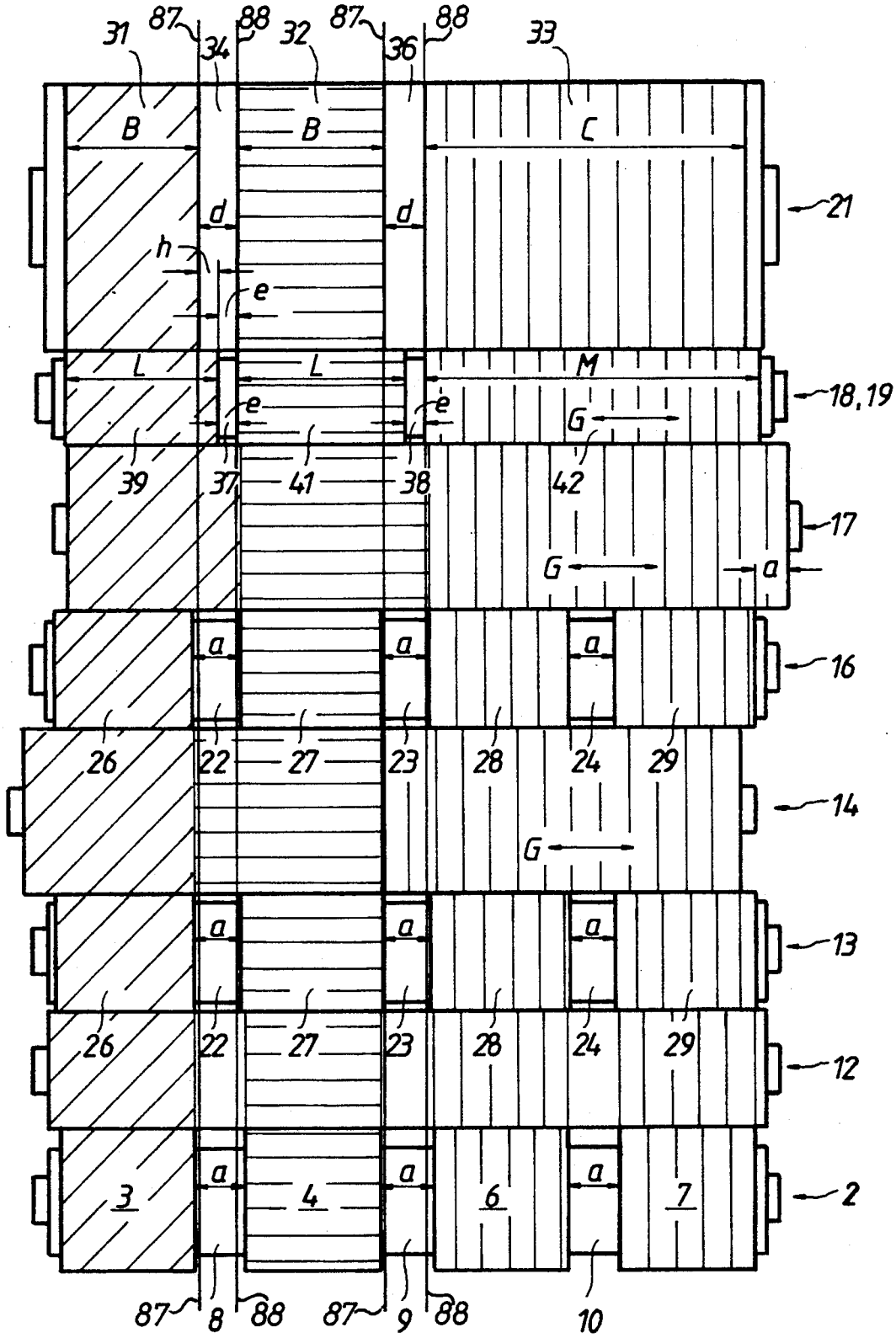
FIG. 2 is a view similar to FIG. 1 and showing the ink application rollers and the ink friction cylinders in second, opposite axial end positions.
Figure 3:
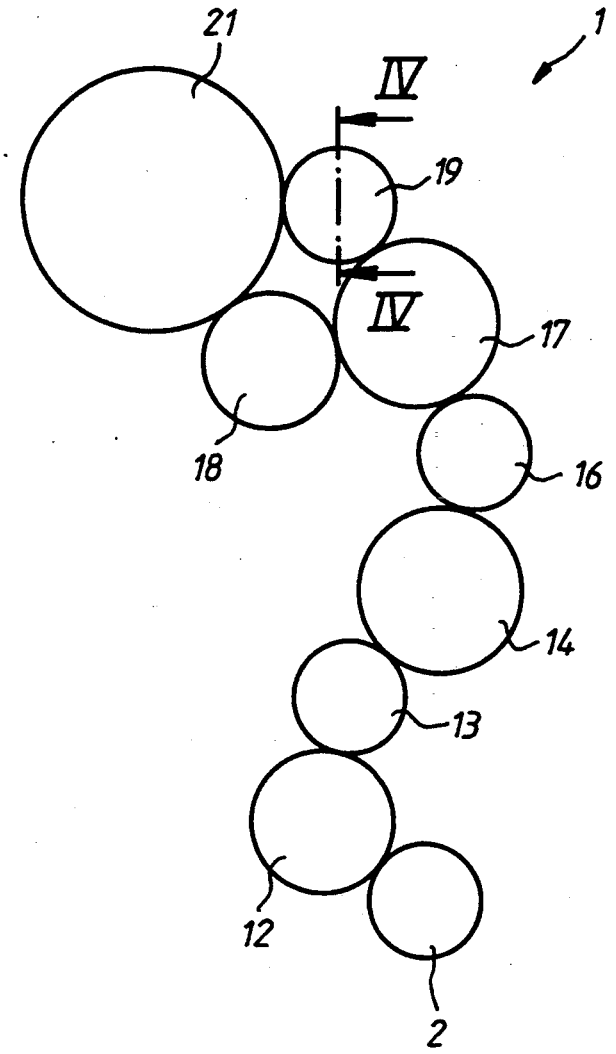
FIG. 3 is a schematic side elevation view of the inking system in accordance with the present invention.

Referring initially to FIG. 3, and taken in conjunction with FIGS. 1 and 2, there may be seen a preferred embodiment of an inking system for a web-fed rotary printing press, generally at 1. Inking system 1 has, as may be seen most clearly in FIGS. 1 and 2, an ink ductor 2 having four adjacent annular jacket faces 3, 4, 6 and 7, which are separated by recesses or annular grooves 8, 9 and 10, each having a first axial width "a". A quarter-width wide ink box or ink reservoir, not shown, is associated with each jacket surface. Separating shields between adjacent ink reservoirs interconnectedly extend into the annular grooves 8, 9 and 10 and in this way separate the individual ink boxes from each other. A film roller 12 follows the ink ductor 2 and contacts it. This ink film roller 12 is, in turn, connected with a first ink friction cylinder 14 by way of a first ink transfer roller 13. A second ink transfer roller 16 is disposed between the first ink friction cylinder 14 and a second ink friction roller 17 which is also, in turn, connected at its circumference with a plate cylinder 21 by way of two ink application rollers 18 and 19 in accordance with the invention, and which extend parallel to each other. The plate cylinder 21 cooperates with a rubber blanket or impression cylinder, which is not shown in the drawings. The first ink transfer roller 13 and the first ink friction roller 14 operate as a first set while the second ink transfer roller 16 and the second ink friction roller 17 operate as a second set. As may be seen most clearly in FIG. 3, the first and second ink application rollers 18 and 19 are both in contact with the plate cylinder 21 and with the second ink friction roller 17.

The ink film roller 12 has a continuous jacket surface, as do the first and second ink friction cylinders 14 and 17, which can be moved back and forth in the axial direction, as indicated by the arrow G on each of these cylinders 14 and 17. The first and second ink transfer rollers 13 and 16, which cooperate with the first and second ink friction cylinders 14 and 17, respectively, have axially spaced annular grooves 22, 23 and 24, each having a width "a" in their jacket surfaces, with the annular grooves being used to divide the entire jacket surface into even-sized, annular jacket surfaces 26, 27, 28 and 29. The plate cylinder 21 has three printing plates 31, 32 and 33 on its circumference. The first two printing plates 31 and 32, respectively, each corresponds to approximately one quarter of the width of the plate cylinder 21 and each has a maximum print width B. The third printing plate 33 is intended for a panoramic print, taking up approximately half the width of the plate cylinder 21 and having a maximum print width C. There are annular ink-free zones 34 and 36 each of a respective width "d" extending around the circumference of plate cylinder 21 between the printing plates 31, 32 and 33. These zones 34 and 36 are bounded by alignment lines 87 and 88. The alignment lines 87 and 88 extend within the area "a" of the annular grooves on the ink ductor 2 or on the ink transfer rollers 13 and 16. Thus width "d" is less than width "a".

The two ink application rollers 18 and 19 extending parallel to each other between the ink friction cylinder 17 and the plate cylinder 21 each have two annular grooves 37 and 38 on their circumferences, in a manner analogous to the number of the ink-free zones 34 and 36 on the plate cylinder 21. The annular grooves 37 and 38, respectively, separate jacket surfaces 39, 41 and 42 of the first and second ink application rollers 18 and 19 from each other. The widths L and M of the jackets 39, 41 and 42 are a little greater than the widths B, and, respectively, C of the printing plates 31, 32 and 33 on the plate cylinder 21. The annular grooves 37 and 38 each have a third width "e" which is less than the second width "d" of the ink-free grooves or zones 34 and 36 on the plate cylinder 21. Accordingly, the widths L and M of the jacket surfaces 39, 41 and 42 are respectively greater by the difference "d"-"e" than the print width B and C of the printing plates 31, 32 and 33.

The various rollers or cylinders 2, 12, 14, 17, 21 are rotatably supported in side frames (not shown) of the press. The rollers 13, 16, 18 and 19 are disposed in bearing arms, as depicted schematically in FIGS. 4, 5 and 6, which are fixedly hinged to the side frames. The rollers 13, 16, 18 and 19, seated in bearing arms, are frictionally driven by their jacket surfaces by the rollers or cylinders 2, 12, 14, 17 or 21. It will be understood that the ink ductor roller 2, the film roller 12, the first and second ink transfer rollers 13 and 16, and the plate cylinder 21 are supported for rotation between side frames of the printing press in a generally conventional manner which forms no part of the subject invention. Suitable conventional drive means, which are not specifically shown in the drawings, are provided for these rollers. The first and second ink friction rollers 14 and 17 are rotatably supported and axially shiftable in a generally conventional manner. The first and second ink application rollers are supported in bearing arms in a manner which will be discussed in detail shortly. These ink application rollers 18 and 19 are shiftable axially through axial movement of the second ink friction roller 17 within which they are both in contact, as seen in FIGS. 1-3.

The inking system 1 in accordance with the present invention, with the ink application rollers 18 and 19, functions in the following manner. The printing inks of the colors yellow (diagonally lined), blue (horizontally lined) and twice red (vertically lined) are supplied in the same sequence to the four jacket surfaces 3, 4, 6 and 7 of the ink ductor 2 from the ink boxes or reservoirs, not shown, and are transferred by the film roller 12 and the ink transfer roller 13 to the first ink friction cylinder 14, which moves back and forth in the axial direction of movement G. From there, the printing inks reach the second axially movable ink friction cylinder 17 by the second ink transfer roller 16. Because of the back-and-forth movement of the ink friction cylinder 17 in the axial direction G with a traversing length corresponding to the first width "a" of the annular grooves 8, 9 and 10 of the ink ductor 2 and also the same first width "a" of the annular grooves 22, 23 and 24 of the ink friction cylinders 13 and 16, each portion of the surface on the ink friction cylinder 14 is coated with one of the yellow, blue and red inks over an annular surface of the width of the non-axially shiftable roller portion which it contacts, plus the width "a".

FIG. 1 shows the ink application rollers 18 and 19 as well as the ink friction roller 17, in first, axial end positions on the left side of the plate cylinder 21. In the course of the changing traversing movement G of the ink friction cylinder 17 toward the left by the amount "a", the ink application rollers 18 and 19 are shifted along over a traversing length h, resulting from the difference between the second and third widths "d" and "e", due to their frictional connection by the jacket surface of the ink friction cylinder 17. In this connection, the width "d" means the width of the annular ink-free zones 34 and 36 between the printing plates 31, 32 and 33 on the plate cylinder 21, and the width "e" is the width of one of the annular grooves 37 and 38 extending around the ink application rollers 18, 19. Accordingly, $a>d>e$. FIG. 2 shows the ink application rollers 18 and 19 and the ink friction roller 17 in a second axial end position on the right side of the plate cylinder 21. As discussed above, the means used to shift the first and second ink friction rollers 14 and 17 axially through their respective shifting distances "a" is generally conventional. The first and second ink application rollers 18 and 19 are shifted with the second ink frictional roller 17 by friction contact between these three rollers.

By means of the ink application rollers 18 and 19 moving along with the ink friction roller 17 in the axial direction G, it is possible to apply different printing inks to the two quarter-cylinder-wide printing plates 31, 32 of maximum print width and to a half-cylinder-wide panoramic printing plate 33 of maximum width. Maximum print width means that the distances "d" of the ink-free zones or grooves 34 and 36 are less than the distances "a" between the ink-free zones 8, 9 and 10 of the ink ductor 2, so that intermixing of the printing inks by the second ink friction roller 17 does not occur.

Figure 4:
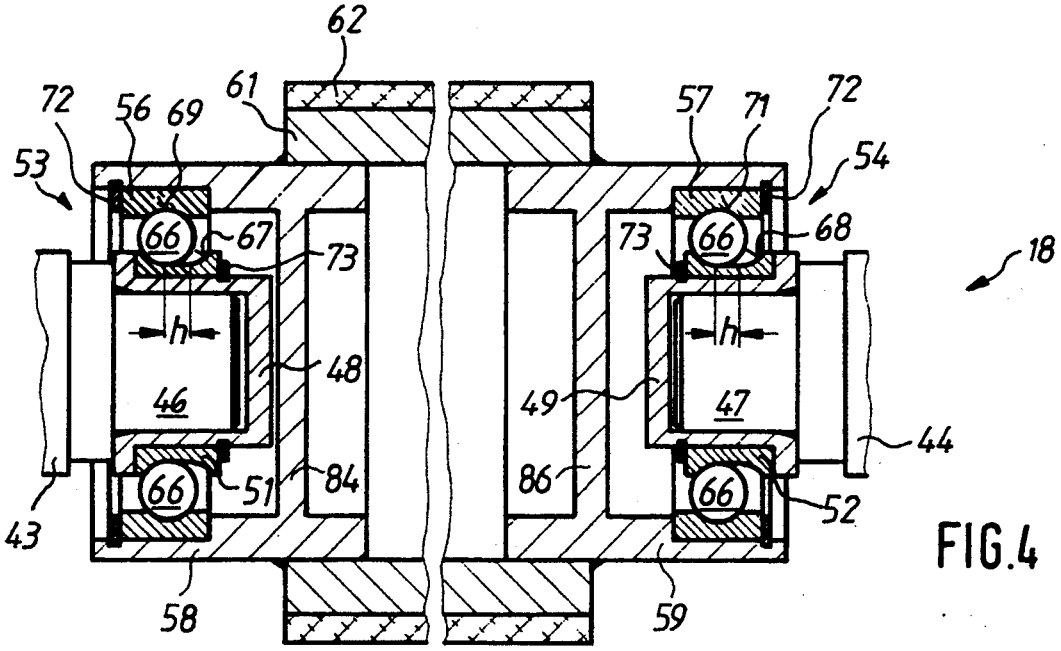
FIG. 4 is a longitudinal cross-sectional view of one of the ink application rollers, taken along line IV—IV of FIG. 3 and showing the ink application roller in its first axial end position.
Figure 5:
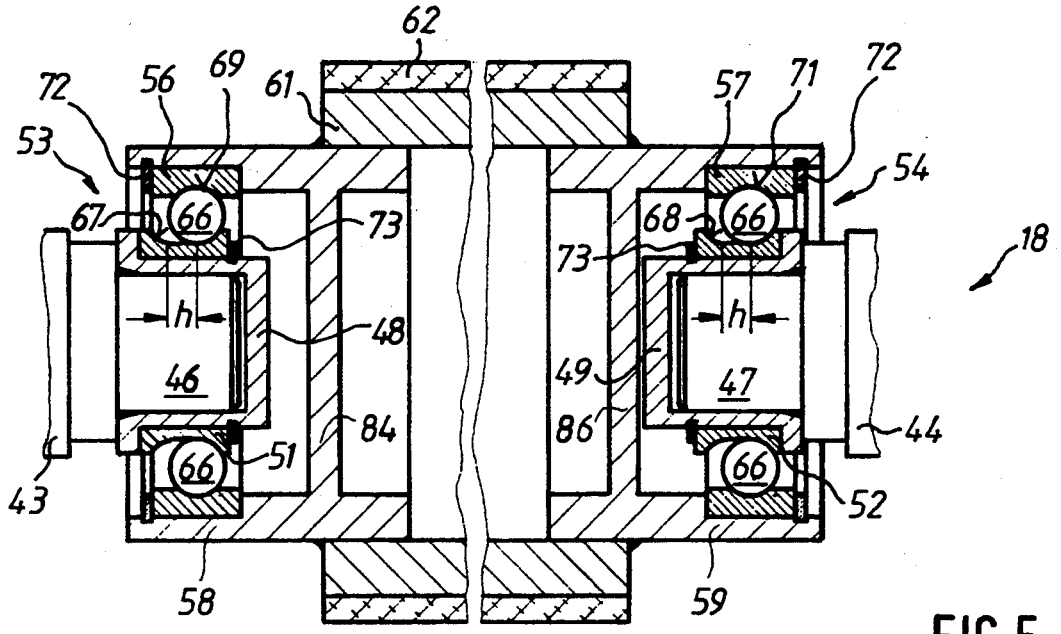
FIG. 5 is a view similar to FIG. 4 and showing the ink application roller in its second axial end position.

To achieve the movement of the two ink application rollers 18 and 19 in the axial direction G, a direction of the support of the ink application roller 18 is shown in the illustrations of FIGS. 4 and 5. Mechanically retractable journals 46 and 47 are disposed in bearing arms 43 and 44 which are pivotably fixed in the side frame, not shown, and which engage bearing bushes 48 and 49 which are disposed on the two end faces of the ink application roller 18 in a non-positive manner. An inner ring or race 51 or 52 of a deep groove ball bearing, indicated generally at 53 or 54, is disposed in a non-positive manner on the outer circumference of the bearing bushes 48 and 49. An outer ring or race 56 or 57 of the deep groove ball bearing 53 or 54 rests precisely fitted against the interior circumference of a hollow-cylinder-shaped support body 58 or 59, respectively, which extends from the end face of a tube-shaped roller body 61 of the ink application roller 18. The roller body 61 has portions coated with plastic and forming the jacket surfaces 39, 41 and 42 of the ink application roller 18, and which are separated by the annular grooves 37 and 38. The annular grooves 37 and 38 are of such depth, for example one to three mm, that it is assured that only the jacket surfaces 39, 41 and 42 of the ink application rollers 18 and 19 are wetted by the printing ink. An inner ring or race 51 or 52 of the deep groove ball bearing 53, 54 is ground out in the axial direction through an axial distance "h", so that the balls 66 have a running surface 67 or 68 which is widened by an amount "h". The amount "h" also corresponds to the axial traversing length "h" of the ink application roller 18. The outer ring or race 56, 57 has a known ball seating 69 or 71. It is also possible to dispose the known ball seating 69 or 71 in the inner ring or race 51, 52 and the ground-out running surface 67, 68, widened by the amount "h", in the outer ring or race 56, 57. The deep groove ball bearings 53, 54 are held on both sides by securing rings 72 and 73.

FIG. 5 shows the ink application roller 18 in a second right axial end position in accordance with FIG. 2. The ink application roller 19 is seated analogously to the ink application roller 18. In place of the approximately quarter-cylinder-wide printing plates 31, 32, it is also possible to arrange an approximately half-cylinder-wide panoramic printing plate 33 with a minimal ink-free zone "d" on the plate cylinder 21, so that only a total of two printing inks are transferred, but the intermixing of the printing ink is prevented.

Figure 6:
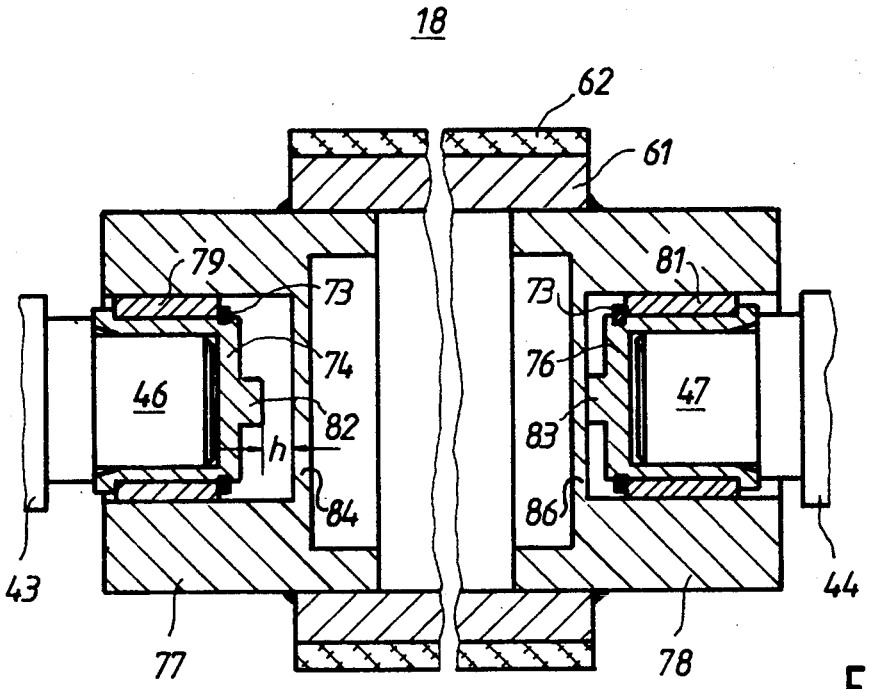
FIG. 6 is a view similar to FIG. 5 and showing the ink application roller supported in friction bearings instead of ball bearings.

A second exemplary embodiment of the seating of an ink application roller 18 or 19 is illustrated in FIG. 6. Here, too, mechanically retractable journals 46 and 47, which engage bearing bushes 74, 76, are disposed in bearing arms 43, 44 which are pivotably fixed in side frames (not shown). An annular friction bearing 79 or 81, respectively secured by a securing ring 73, is disposed between the outer jacket of the bearing bushings 74 or 76 and the inner circumference of a hollow-cylinder-shaped support body 77 or 78, respectively, extending from the end face of the tube-shaped roller body 61 of the ink application roller 18. In FIG. 6, the ink application roller 18 is in the right axial end position, so that the next traversing of a traversing length "h" must be made to the left. On their outside, the bearing bushes 74 and 76 have cylinder-shaped stops 82 and 83 which, during the axial traversing movement of the ink application roller 18, come to rest against limiting disks 84 and 86, respectively, of the support body 77 or 78. Limiting disks 84 and 86 of this type are also provided with the bearing arrangement of FIGS. 4 and 5.

Figure 7:
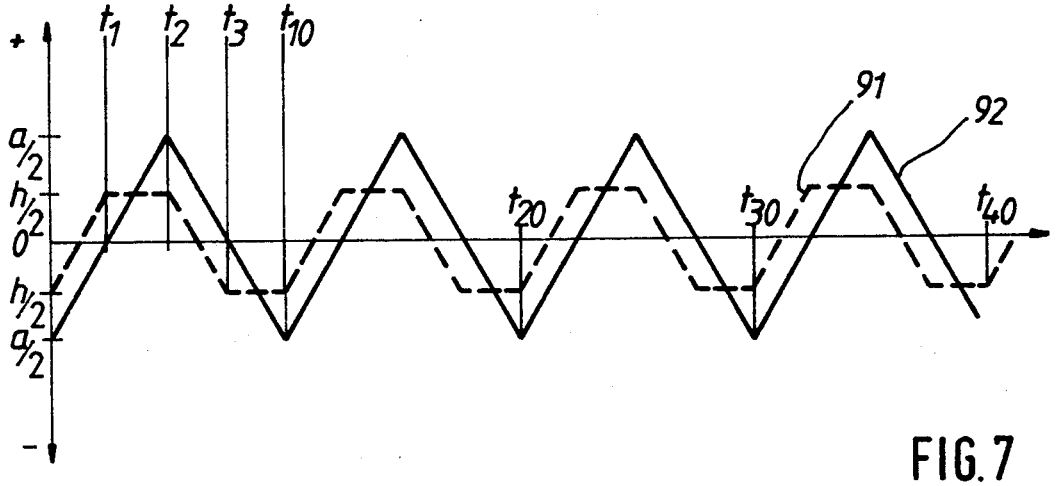
FIG. 7 is a path-time diagram of the axial movement of an ink application roller and an ink friction cylinder in accordance with the present invention.

FIG. 7 shows a path-time diagram of the axial movement of the ink application rollers 18 and 19 of the invention in connection with the ink friction cylinder 17. A first curve 91, shown in dashed lines, represents the course of movement of one of the ink application rollers 18 or 19. A second curve 92 represents the course of movement of the ink friction cylinder 17. It can be seen from the curves 91 and 92 that the traversing length "a" of the ink friction cylinder 17, extending on the ordinate of the diagram from $-a/2$ to $+a/2$, is greater than the traversing length "h" of one of the ink application rollers 18 or 19. A total of four traverses $t_{10}$ to $t_{40}$, i.e. back and forth movements of the ink friction cylinder 17 with the ink application rollers 18, 19, of which only the ink application roller 18 is mentioned, are shown on the horizontally extending time axis. At the time $t_{zero}$, which is the left axial end position of the ink friction cylinder 17 and the ink application roller 18 as depicted in FIGS. 1 and 4, both rollers 17 and 18 start to move in the direction toward the right axial end position. At the time $t_1$, in accordance with the curve 91, the ink application roller 18 has reached its right axial end position after traveling over its axial traversing length "h", i.e. from $-h/2$ to $+h/2$. In accordance with the curve 92, the ink friction roller 17 continues moving through its traversing distance $+a/2$ until the time $t_2$ and takes up the position shown in FIGS. 2 and 5. At the same time $t_2$, the ink application roller 18 ends its stay in the right axial end position in FIG. 2 and is moved in the direction $-h/2$ by its frictional contact with the ink friction cylinder 17 and, after traveling the traversing length "h", has reached its left axial end position shown in FIG. 1 at the time $t_3$. The ink friction cylinder 17 continues to move until it has traveled the traversing length "a" at the time $t_{10}$ shown on the curve 92. Thus a total traversing consisting of four traversings as shown in FIG. 7 has been performed. The further traversings $t_{10}/t_{20}$, $t_{20}/t_{30}$, $t_{30}/t_{40}$ take place in an analogous manner. A traversing, for example $t_0$ to $t_{10}$, of the rollers 17 and 18 in the axial direction takes place during approximately four revolutions of the plate cylinder 21.

It is of course possible to exchange the ink application roller 18 or 19 for a normal ink application roller without recesses or annular grooves if it is not necessary to produce two quarter-cylinder-wide prints of maximum width in addition to one half-cylinder-wide panoramic print.

While a preferred embodiment of an inking system for a web-fed rotary printing press in accordance with the present invention has been set forth fully and completely hereinabove, it will be apparent to one of skill in the art that a number of changes in, for example, the overall sizes of the cylinders, the colors of the inks used, the specific supports for the plate cylinder and the like could be made without departing from the true spirit and scope of the present invention which is accordingly to be limited only by the following claims.

What is claimed is:

1. An inking system for a rotary printing press, wherein an ink ductor roller having a jacket surface with "n" spaced recesses is in cooperation with "n+1" ink boxes which are disposed next to each other in an axial direction of said ink ductor roller and which are provided with separating shields; wherein "n" printing inks are provided from said "n+1" ink boxes for further movement by an ink transfer roller having "n" recesses on jacket surfaces of said ink transfer roller, a back-and-forth-moving ink friction cylinder provided with means for supporting said ink friction cylinder for said back-and-forth movement at a first traversing frequency, and an ink application roller, to a plate cylinder having a half-cylinder-wide first printing plate for panoramic printing, as well as at least one quarter-cylinder-wide second printing plate with type matter of maximum width and with ink-free zones between the type matter, and wherein "n" is at least three; said ink application roller having at least one annular groove in its jacket face between adjoining printing inks, said ink application roller being disposed between said plate cylinder and said ink friction cylinder and being supported for back-and-forth movements and making said back-and-forth movements at a second traversing frequency which is the same as said first traversing frequency but of a lesser traversing length, wherein a width "a" of each of said "n" spaced recesses of said ink ductor roller is greater than a width "d" of each of said ink-free zones of said plate cylinder, said width "d" of said ink-free zones between said printing plates of said plate cylinder being greater than a width "e" of said at least one annular groove of said ink application roller, and that said at least one annular groove of said ink application roller can be moved by said back and forth movement of said ink application roller over the width "e" in said width "d" between alignment lines of said spaced recesses, having said width "a", of said ink ductor roller.

2. The inking system of claim 1 wherein said ink application roller includes at least one support body disposed at an end face of a roller body portion of said ink application roller and being nonpositively connected by a deep groove roller bearing with a roller holder, and further wherein an inner ring of said deep groove roller bearing has a running surface which is axially widened and wherein said roller body can move back and forth by an axial traversing length "h".

3. The inking system of claim 1 wherein said ink application roller includes at least one support body disposed at an end face of a roller body portion of said ink application roller and being nonpositively connected by a deep groove roller bearing with a roller holder, and further wherein an outer ring of said deep groove roller bearing has a running surface which is axially widened and wherein said roller body can move back and forth by an axial traversing length "h".

4. The inking system of claim 1 wherein said ink application roller includes at least one support body disposed at an end face of a roller body portion of said ink application roller and being nonpositively connected by a friction bearing with a roller holder and further wherein said roller body portion can move back and forth along an axial traversing length "h".

5. The inking system of claim 1 wherein said ink application roller is rotated by frictional contact with said plate cylinder and said ink friction cylinder and further wherein said ink application cylinder is moved in said back and forth manner by frictional contact with said back-and-forth moving ink friction cylinder.

6. An inking system for a rotary printing press, said inking system comprising:

an ink ductor roller having at least four axially spaced annular ductor roller jacket faces separated by first annular grooves having first widths;

means to supply ink to said annular faces of said ink ductor roller;

an ink film roller in contact with said ink ductor roller;

first and second ink transfer roller sets each having an ink transfer roller having annular transfer roller jacket faces separated by second annular grooves having said first widths, and an ink friction roller, said ink transfer roller of said first ink transfer roller set contacting said ink film roller;

means to axially shift said ink friction rollers in each of said first and second ink transfer roller sets;

at least a first ink application roller having annular ink application roller jacket faces separated by third annular grooves having second widths, said at least first ink application roller being in contact with said ink friction roller of said second ink transfer roller set; and a printing plate cylinder having an axial length and having a half cylinder wide printing plate for panoramic printing and at least one quarter cylinder wide printing plate, said half cylinder wide printing plate and said at least one quarter cylinder wide printing plate being separated by a fourth annular groove having a third width, said third width being greater than said second width and less than said first widths.

* * * * *